US005292036A

United States Patent [19]

Thome

[11] Patent Number: 5,292,036

[45] Date of Patent: Mar. 8, 1994

[54] ADJUSTABLE CAPACITY STORAGE TANK FOR LIQUID PRODUCT

[75] Inventor: Caryl Thome, Saint Egreve, France

[73] Assignee: Sames S.A., Meylan, France

[21] Appl. No.: 895,706

[22] Filed: Jun. 9, 1992

[30] Foreign Application Priority Data

Jun. 11, 1991 [FR] France ..... 91 07050

[51] Int. Cl.[5] ..... B05B 9/047; B05B 5/16; B67D 5/60

[52] U.S. Cl. ..... 222/333; 239/322; 239/324; 239/708; 222/389; 222/390

[58] Field of Search ..... 239/3, 322, 324, 690, 239/708; 220/4.12, 565; 222/333, 389, 390

[56] References Cited

U.S. PATENT DOCUMENTS

| | | | |
|---|---|---|---|
| 2,531,366 | 11/1950 | Smith | 222/390 X |
| 3,128,912 | 4/1964 | Cash | 222/389 X |
| 3,294,058 | 12/1966 | Shriro | 239/324 X |
| 3,390,815 | 7/1968 | Kavan et al. | 222/390 X |
| 3,906,122 | 9/1975 | Krause et al. | 239/708 X |
| 4,785,760 | 11/1988 | Tholome | 118/323 |
| 4,879,137 | 11/1989 | Behr et al. | 427/27 |
| 4,921,169 | 5/1990 | Tilly | 239/690 X |
| 5,042,696 | 8/1991 | Williams | 222/389 X |
| 5,100,690 | 3/1992 | Planert et al. | 239/3 X |
| 5,106,024 | 4/1992 | Frene et al. | 239/690 |
| 5,221,194 | 6/1993 | Konieczynski et al. | 239/708 X |

FOREIGN PATENT DOCUMENTS

| | | | |
|---|---|---|---|
| 0292778 | 11/1988 | European Pat. Off. . | |
| 319353 | 1/1972 | U.S.S.R. | 239/708 |

*Primary Examiner*—Andres Kashnikow
*Assistant Examiner*—William Grant
*Attorney, Agent, or Firm*—Spensley Horn Jubas & Lubitz

[57] ABSTRACT

A storage tank for a liquid product such as a coating product to be sprayed comprises an internal piston dividing the storage tank into a first chamber receiving the coating product under pressure and a second chamber receiving a pressurized actuator fluid. The piston is mechanically coupled to a step mode actuator.

8 Claims, 1 Drawing Sheet

ADJUSTABLE CAPACITY STORAGE TANK FOR LIQUID PRODUCT

BACKGROUND OF THE INVENTION

1. Field of the invention

The invention concerns an adjustable capacity storage tank for liquid product enabling the quantity of liquid entering the tank when it is filled to be determined and the flowrate of the liquid expelled from the tank by displacement of a piston to be monitored.

The invention is more particularly concerned with a storage tank of this kind usable in an installation for spraying a liquid coating product and especially in an installation of this kind in which the coating product is a relatively good electrical conductor, is supplied from a grounded source and is to be applied by electrostatic means.

2. Description of the prior art

U.S. Pat. No. 4 785 760 describes an electrostatic coating product sprayer installation in which an intermediate storage tank insulated from ground is mounted at the end of an articulated arm. In use, the coating product storage tank is filled with just enough product to coat one or more objects to receive the same coating product (in other words, the same color). In one embodiment the storage tank encloses a mobile piston delimiting a first chamber adapted to receive the coating product and a second chamber adapted to receive an actuator fluid, to be more precise compressed air. The coating product is supplied under pressure, enabling the storage tank to be filled by pushing back the piston. During use the storage tank is pressurized by compressed air admitted to the second chamber and the coating product therefore flows progressively from the storage tank to an electrostatic sprayer. In a system of this kind it is necessary to monitor the displacement of the piston both when filling the storage tank, to monitor the quantity of product admitted to the tank, and during application of the coating product because it may be necessary to modify the flowrate at any time depending on the shape of the object to be coated. To achieve this the response time of the means monitoring the displacement of the piston must be as short as possible. In a high throughput installation such as an installation for coating automobile bodies, for example, the response time of the systems for evaluating the contents of the storage tank and for controlling the flowrate of the coating product to the sprayer must be in the order of 70 milliseconds, assuming that the sprayer must be capable of movement at 1.5 meters per second and that the flowrate must be modified during a displacement of not more than 0.1 meter. It is difficult to achieve this with entirely pneumatic control. The problem becomes more complicated if the combination of the storage tank and the associated piston actuator means is required to be compact and light in weight so that it can be mounted at the end of an articulated robot arm.

The invention makes it possible to solve all these problems.

SUMMARY OF THE INVENTION

The invention consists in a storage tank for a liquid product such as a coating product to be sprayed comprising an internal piston dividing said storage tank into a first chamber adapted to receive said coating product under pressure and a second chamber adapted to receive a pressurized actuator fluid and a step mode actuator mechanically coupled to the piston for monitoring or controlling its displacement.

In other words, the invention consists in providing a coupling between the fluid pressure-based piston drive means (relying on the pressure of the coating product for filling and air pressure exerted on the other side of the piston during application of the coating product) supplying at least some of the energy required to move the piston and compact and lightweight electromechanical means forming a motor, motor-brake or locking member and enabling very fast and very accurate monitoring of piston displacement.

The electromechanical means in question (the "step mode actuator" referred to in the above summary of the invention) may be of various kinds:

A system comprising an escapement-type locking mechanism or a clutch mechanism actuated by a solenoid, for example. A mechanism of this kind may comprise a toothed wheel and a system of escapement teeth moved by the solenoid, for example, or any electrically controlled analogous means.

A relatively low power step-by-step motor which is therefore of low weight and compact overall dimensions, assisted by a pressurized fluid to displace the piston, this fluid being the coating product itself during filling and compressed air during application of the product. The arrangement can be such that the motor operates without slip and either as a motor, in other words adding its force to that of the drive fluid, or as a motor-brake, in other words enabling on each control pulse a predetermined unit displacement of the piston acted on by the pressurized fluid.

The piston may be coupled to the step mode actuator by a lead screw and nut system or by a rack and pinion system. A lead screw and nut system can be irreversible to the degree needed to guarantee stability of the piston in any position. If the actuator is itself irreversible, which is the case with a step-by-step motor in normal operating conditions, the lead screw and nut system need not be irreversible and in this case a lead screw and recirculating ball nut system may advantageously be used.

The invention will be better understood and other advantages of the invention will emerge more clearly from the following description of various embodiments of a storage tank in accordance with the invention given by way of example only and with reference to the accompanying diagrammatic drawings.

DETAILED DESCRIPTION OF THE INVENTION

Figure 1:
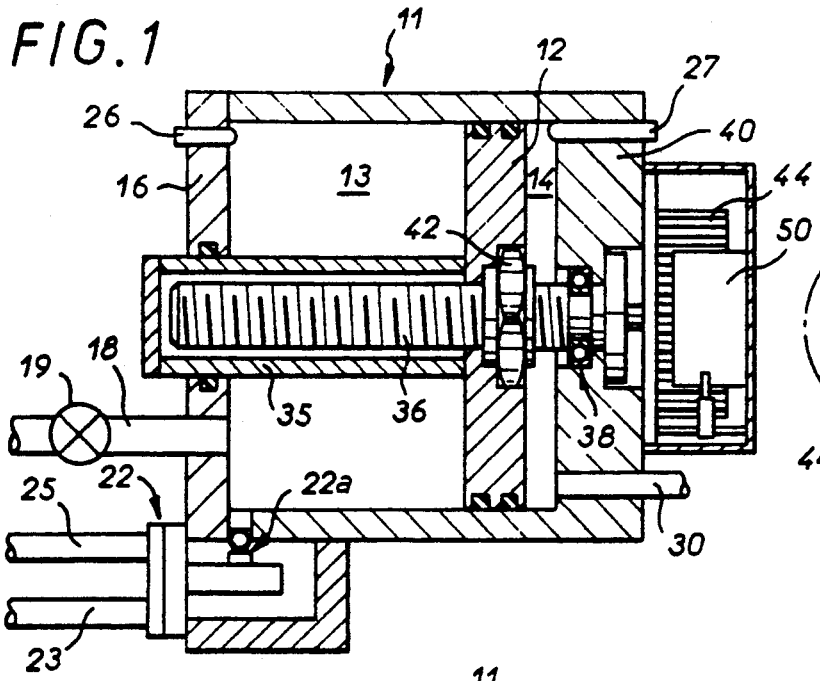
FIG. 1 is a diagrammatic view of a first embodiment of a storage tank in accordance with the invention shown at a filling station.
Figure 1A:
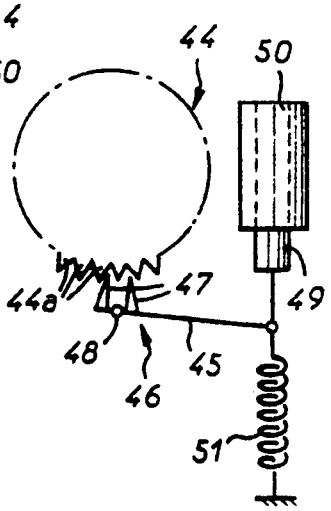
FIG. 1A is a partial diagrammatic view of an actuator mechanism associated with the storage tank from FIG. 1.
Figure 3:
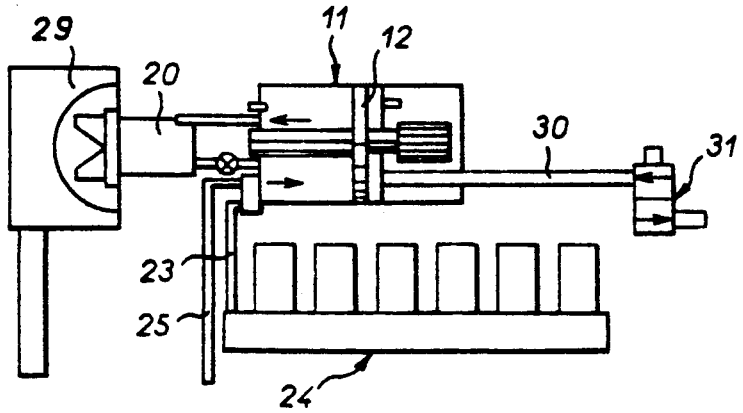
FIG. 3 is a diagrammatic view of a storage tank of this kind connected to a sprayer, the combination being shown in a cleaning and filling position.

Referring to FIGS. 1, 1A and 3 in particular, a generally cylindrical insulative material storage tank 11 incorporates an insulative piston 12 which is prevented from rotating but can move axially inside the storage tank in which it separates a first chamber 13 adapted to receive a liquid coating product (paint or varnish) which is electrically conductive in this example from a second chamber 14 adapted to receive a pressurized actuator fluid which is compressed air in this example. An outlet 18 on a front wall 16 of the storage tank communicating with the first chamber 13 is connected by a valve 19 to a coating product sprayer 20 (FIG. 3) which in this example is of the electrostatic type, which means that it is at a high voltage during a product spraying phase. The storage tank is preferably fixed to the end of an articulated robot arm (not shown) from which it is electrically insulated. A quick-action connecting arrangement 22 which is known in itself cooperates with a valve **22*a* of the storage tank to enable coating product to enter the chamber 13. The product is fed through a pipe 23 connected to a coating product change unit 24 which is known in itself (FIG. 3). The quick-action connecting arrangement 22 incorporates a drain circuit 25 so that when the storage tank is in the condition shown in FIG. 3 the first chamber can be drained of any excess coating product and then cleaned and dried using a rinsing product and air supplied by the unit 24 and finally filled with a selected coating product delivered under pressure by the same unit. In the configuration shown in FIG. 3 the sprayer 20 is facing a receptacle 9 known as a "rinsing box" adapted to receive and evacuate the rinsing liquid passed through the sprayer to clean it. This receptacle preferably includes means for cleaning the exterior parts of the sprayer. Two end of travel abutments 26, 27 indicate extreme positions of the piston 12. The chamber 14 communicates with a compressed air supply (not shown) through a pipe 30 and a three-way valve 31. The latter valve controls the entry of compressed air into the chamber 14** or venting of the chamber to the atmosphere.

The piston 12 has a cylindrical hollow axial extension 35 enclosing a lead screw 36 supported by a bearing 38 housed in the end wall 40 of the storage tank at the same end as the chamber 14. The lead screw 36 meshes with a nut 42 fastened to the piston 12. The end of the lead screw 36 adjoining the wall 40 carries a toothed wheel 44 which is part of an escapement locking mechanism 46 comprising a lever 45 with two teeth 47 one on each side of its pivot 48, said lever being articulated to the mobile slug 49 of a solenoid 50. A tension spring 51 urges the slug into a rest position. Referring to FIG. 1A, the two teeth 47 evidently cooperate with the teeth **44*a* of the toothed wheel 44 so that the latter can only rotate one tooth at a time for each stroke of the solenoid 50. The system comprising the solenoid and the mechanism 46 constitutes a step mode actuator coupled to the piston 12 by way of the lead screw and nut system 36, 42**. Because the actuator is irreversible, the lead screw and nut system may be of the recirculating ball type.

Figure 2:
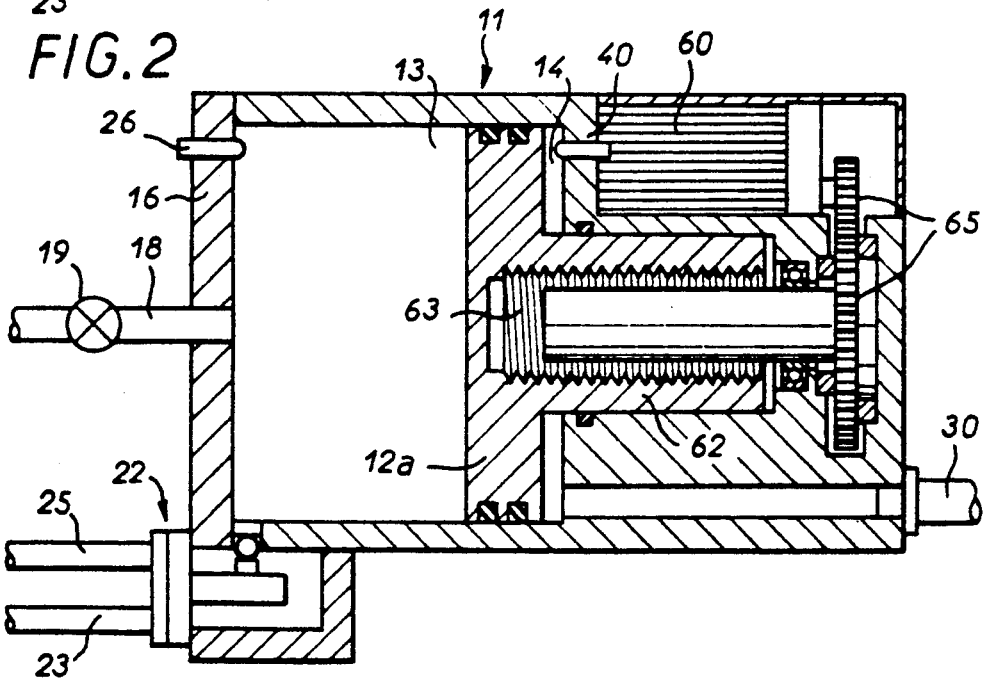
FIG. 2 is a view analogous to FIG. 1 of a second embodiment.

FIG. 2 shows an alternative embodiment in which the solenoid of the step mode actuator is replaced by an electric step-by-step motor 60. The motor has a relatively low power rating because it does not have to provide all of the force needed to move the piston; it is therefore compact and light in weight. Structural parts of this embodiment analogous to those of FIGS. 1 and 3 are identified by the same reference numbers and will not be described again. Prevented from rotating, the piston **12*a* comprises a tubular piston rod 62 which is screwthreaded internally and thereby forms a nut. It receives a lead screw 63 rotated by the motor 60 via a gear train 65**. The motor is naturally supplied with electric pulses by a source that is not shown.

Operation can be similar to that previously described. The piston is moved in one direction or the other by the resultant forces due to the pressures in the chambers 13 and 14 but this occurs under the control of the motor 60. This receives pulses whereby its rotation enables movement of the piston over a predetermined unit distance on each pulse. This type of motor can be locked up and so function as a brake or a locking member without damaging it. Instead of operating as a brake, the motor can be controlled to contribute positively to the displacement of the piston if the pressures in the chambers 13 and 14 are set to sufficiently low values that they are unable to move the piston without the additional force provided by the step-by-step motor. The motor then operates within its normal torque range, despite its relatively low power rating. As the step-by-step motor may be regarded as irreversible, the lead screw and nut system 62–63 may be of the recirculating ball type.

There is claimed:

1. Storage tank for a liquid coating product to be sprayed comprising: an internal piston dividing said storage tank into a first chamber adapted to receive the coating product under pressure and a second chamber adapted to receive a pressurized actuator fluid; and a step mode actuator coupled to said piston by means of a lead screw and nut system for controlling displacement of said piston during spraying of the coating product while piston is urged by the pressurized fluid in said second chamber.

2. Storage tank according to claim 1 wherein said lead screw and nut system is substantially irreversible.

3. Storage tank according to claim 1 wherein said step mode actuator is substantially irreversible and said lead screw and nut system constitute a recirculating ball mechanism.

4. Storage tank according to claim 1 wherein said step mode actuator comprises an escapement locking mechanism coupled to said piston.

5. Storage tank according to claim 4 wherein said step mode actuator comprises a solenoid.

6. Storage tank according to claim 1 wherein said step mode actuator comprises an electric step-by-step motor.

7. Storage tank according to claim 6 wherein said electric step-by-step motor is connected to operate as a motor-brake.

8. Storage tank according to claim 6 wherein the pressure of said actuator fluid is less than that required to move said piston and said electric step-by-step motor is adapted to develop an additional force enabling displacement of said piston.

* * * * *